United States Patent [19]

Bajohr

[11] 4,056,168

[45] Nov. 1, 1977

[54] ARRANGEMENT OF THE SUCTION FUNNEL OF AN OIL PUMP IN THE SUMP OF AN INTERNAL COMBUSTION ENGINE

[75] Inventor: Alfred Bajohr, Stuttgart, Germany

[73] Assignee: Daimler-Benz Aktiengesellschaft, Germany

[21] Appl. No.: 637,187

[22] Filed: Dec. 3, 1975

[30] Foreign Application Priority Data

Dec. 5, 1974 Germany ..... 2457508

[51] Int. Cl.[2] ..... F01M 1/10; F01M 11/06

[52] U.S. Cl. ..... 184/6.24; 123/196 A; 138/109; 184/106; 210/168

[58] Field of Search ..... 184/106, 1 R, 1.5, 6, 184/6.2, 6.13, 6.24, 6.27, 6.28, 7 R, 7 C, 7 CR, 8, 11 A, 12, 14, 36, 61, 58, 59; 138/109; 417/366, 368; 418/88, 89; 123/196 A, 196 S; 210/168

[56] References Cited

U.S. PATENT DOCUMENTS

| | | | |
|---|---|---|---|
| 579,956 | 4/1897 | Chapman | 184/14 X |
| 1,369,239 | 2/1921 | Gulick | 184/6.24 |
| 1,399,943 | 12/1921 | Dunham | 184/6.24 |
| 1,800,585 | 4/1931 | Woolson | 210/168 |
| 2,372,286 | 3/1945 | Mieras | 210/168 |
| 2,440,815 | 5/1948 | Wharam et al. | 184/6.2 |
| 3,211,256 | 10/1965 | Teutsch | 184/106 |
| 3,727,725 | 4/1973 | Dahm | 184/6.24 |
| 3,773,144 | 11/1973 | Hummel | 184/6.24 |
| 3,784,011 | 1/1974 | Ward | 210/168 |

FOREIGN PATENT DOCUMENTS

| | | | |
|---|---|---|---|
| 1,113,610 | 9/1961 | Germany | 123/196 A |
| 581,948 | 9/1958 | Italy | 184/106 |

*Primary Examiner*—Richard C. Pinkham
*Assistant Examiner*—Arnold W. Kramer
*Attorney, Agent, or Firm*—Craig & Antonelli

[57] ABSTRACT

An arrangement of the suction funnel of a lubricating oil pump in the oil pan of an internal combustion engine, in which the suction funnel is supported at the bottom of the oil pan by means of an elastic spacer member and the interior space of the suction funnel is in sealed connection with the interior space of the hollow spacer member; the spacer member rests with its lower end on the bottom of the oil pan by means of a bead-like, relatively inelastic support rim which is provided with one or several openings, the spacer member directly surrounds the inlet end of the suction funnel with prestress by means of its part disposed in the upper half thereof and constructed of larger diameter than the lower half in such a manner that a screen filter arranged in the suction funnel is force-lockingly and form-lockingly clamped with its retaining rim clamped between the inlet end of the suction funnel and the part at the upper half of the spacer member.

14 Claims, 2 Drawing Figures

Figure 1:
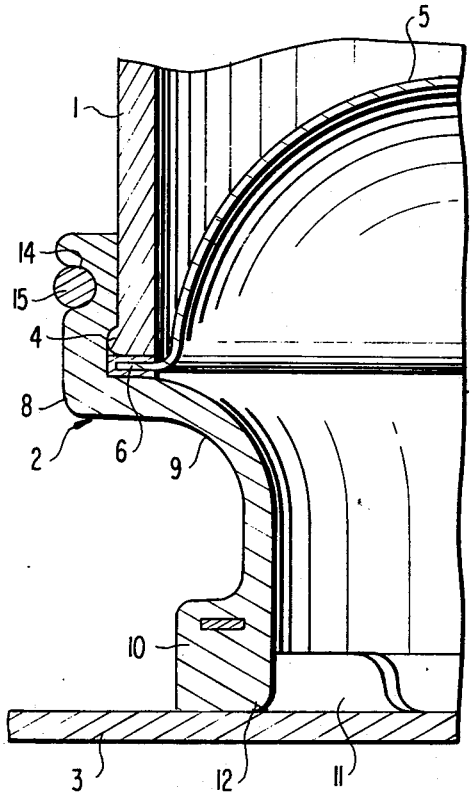

ARRANGEMENT OF THE SUCTION FUNNEL OF AN OIL PUMP IN THE SUMP OF AN INTERNAL COMBUSTION ENGINE

The present invention relates to an arrangement of the suction funnel of a lubricating oil pump within the oil pan or sump of an internal combustion engine, in which the suction funnel is supported at the bottom of the oil pan by means of an elastic spacer member and the interior space of the suction funnel is in sealing connection with the interior space of the hollow spacer member, and in which the spacer member rests at its lower end by means of a bulge-like, relatively inelastic support rim at the bottom of the oil pan in which one or several openings are provided determining the level for an air-free suctioning-off action as described in the German Patent Application P 20 24 814. 0 corresponding to U.S. Pat. No. 3,727,725.

The present invention is concerned with the task to provide an improved and simplified arrangement of the suction funnel of a lubricating oil pump as compared to the subject matter of the aforementioned German application, which enables a still more reliable connection between the spacer member and the suction funnel as regards the sealing action. Therebeyond, damages of the suction funnel as a result of relative movements of metallic structural parts are to be completely eliminated as well as any non-tightness or leakages which might occur in case of deformation of the oil pan bottom or sump bottom, are to be avoided.

The underlying problems are solved according to the present invention in that the spacer member directly surrounds the suction funnel under prestress by means of its part disposed in the upper half and constructed of larger diameter in such a manner that a screen filter of conventional type arranged in the suction funnel is force-lockingly and form-lockingly clamped with its flange-like retaining rim between the suction funnel and the spacer member.

Any connecting elements between the suction funnel and the elastic spacer member such as, for example, snap-rings, reinforcing sheet metal members, annular disks or the like are completely dispensed with by these constructive measures so that in addition to savings in cost, also a simplified installation is possible.

Furthermore, only one sealing place exists in this type of construction.

In order that no rattle noises can occur at the suction funnel during the driving operation, it is additionally provided that the screen filter is molded about at the retaining rim with synthetic resinous material.

This measure also prevents a metal wear and contact corrosion at the suction funnel abutting at the screen filter by reason of the non-metallic material pairing at this place.

It is proposed as further feature according to the present invention that the suction funnel includes a collar which together with the retaining ring supportingly engages in an annular groove arranged in the spacer member in order to avoid an axial displacement of the spacer member relative to the suction funnel and simultaneously to increase the sealing tightness at the connecting place.

In an advantageous construction according to the present invention, a section of the spacer member connecting the upper portion with the lower portion may be so constructed that in case of deformation of the oil sump bottom it spring-deflects into the screen filter with simultaneous abutment at the same without impairing the sealing tightness at the joining place of the suction funnel screen filter.

Accordingly, it is an object of the present invention to provide an arrangement of the suction funnel of a lubricating oil pump in the oil sump of an internal combustion engine which avoids by simple means the aforementioned shortcomings and drawbacks encountered in the prior art.

Another object of the present invention resides in the arrangement of the suction funnel of a lubricating oil pump in the oil sump of an internal combustion engine which enables an improved and simplified arrangement of the suction funnel.

A further object of the present invention resides in an arrangement of the suction funnel of a lubricating oil pump in the oil pan of an internal combustion engine which enables a still more secure connection between the spacer member and the suction funnel, particularly as regards sealing effectiveness.

Still another object of the present invention resides in an arrangement of the suction funnel of a lubricating oil pump in the oil pan of an internal combustion engine in which damages of the suction funnel as a result of relative movements and ensuing wear of metallic structural parts are completely eliminated.

Still a further object of the present invention resides in an arrangement of the suction funnel of a lubricating oil pump in the oil pan of an internal combustion engine in which leakages are prevented in case of deformation of the bottom of the oil pan.

Another object of the present invention resides in an arrangement of the suction funnel of a lubricating oil pump within the oil pan of an internal combustion engine which greatly simplifies the structural arrangement and reduces the costs by dispensing with separate connecting elements between the suction funnel and the elastic spacer member.

A further object of the present invention resides in an arrangement of the suction funnel of a lubricating oil pump in the oil pan of an internal combustion engine in which only a single place to be sealed exists.

Still another object of the present invention resides in an arrangement of the suction funnel of a lubricating oil pump of the type described above in which wear is minimized while rattle noises are far-reachingly precluded.

Figure 2:
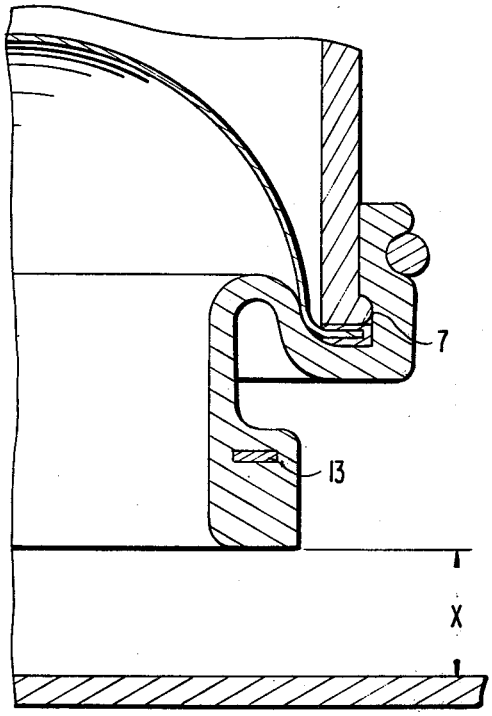

These and further objects, features and advantages of the present invention will become more apparent from the following description when taken in connection with the accompanying drawing which shows, for purposes of illustration only, one embodiment in accordance with the present invention, and wherein:

FIG. 1 is a cross-sectional view through the arrangement of a suction funnel/oil pan in accordance with the present invention, in which the left half of this cross-sectional view shows the spacer member in its position with a non-deformed bottom of the oil pan; and FIG. 2 is a cross-sectional view through the right half of the arrangement of FIG. 1, which illustrates the possible spring path of the spacer member.

Referring now to the drawing figures, a cylindrically formed suction funnel 1 of a lubricating oil pump is illustrated in these figures which, on the one hand, is fixedly retained in an oil pan or sump of an internal combustion engine (not shown) and, on the other, is supported at the bottom 3 of the oil pan by way of an elastomeric spacer member generally designated by reference numeral 2.

The spacer member 2 which has an essentially sleeve-like configuration surrounds under prestress the suction funnel 1 which is provided at its lower end with a collar 4. A semi-spherically shaped screen filter 5 arranged in the suction funnel 1 is provided with a retaining rim 6 constructed in the manner of a flange which is clamped fast between the end surface of the suction funnel 1 and the spacer member 2. The screen filter 5 which consists of a fine-mesh wire and catches the contaminations in the lubricant is provided with synthetic resinous material coating at its retaining rim 6 suitably molded about the same, in order to avoid metallic connections for reasons of the contact corrosion as well as of the metal wear.

The spacer member 2 is provided with a circumferential groove 7 into which the collar 4 and the retaining rim 6 engage sealingly.

The initially cylindrically constructed spacer member 2 abutting under prestress at the suction funnel—the inner diameter of the spacer member 2 is smaller prior to installation than the outer diameter of the suction funnel 1—extends radially inwardly from a place 8—the suction funnel 1 is supported on this section by way of the retaining edge 6 of the screen filter 5—and then after an arcuately shaped section 9 again passes over into a cylindrical form. The lower end of the spacer member 2 is formed by a bulge-like or bead-like rim 10 whose end face 12 provided with apertures 11 for the passage of the lubricant, rests on the bottom 3 of the oil pan. The apertures 11 are so dimensioned that a sufficient suction cross-section is assured.

The arcuately shaped area 9 of the spacer member 2 is so constructed that in case of deformations of the bottom 3, the elastic spacer member 2 is able to spring-deflect into the screen filter 5 by the spring path $x$ and is able to roll off at the screen filter 5 under a certain abutment pressure without impairing in any manner whatsoever the sealing effectiveness at the connecting place as illustrated in FIG. 2.

In order to eliminate the sucking-in of air during curve drives as well as during uphill and downhill drives (inclined position of the oil level in the oil pan), the diameter of the beaded rim 10 as well as the height of the apertures 11 are to be kept as small as possible. Furthermore, a metallic reinforcing ring 13 may be vulcanized into the beaded rim 10 in order to prevent a collapsing or buckling of the beaded rim 10 during inward spring deflection of the spacer member 2.

Possibly, a clamping ring 15 located in an annular groove 14 may be arranged in the upper area of the spacer member 2.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. An arrangement of a suction funnel of a lubricating oil pump in an oil pan of an internal combustion engine, in which the suction funnel is supported at the bottom of the oil pan by means of an elastic hollow spacer means and the interior space of the suction funnel is sealingly connected with the interior space of the hollow spacer means, the spacer means resting with its lower end on the bottom of the oil pan by way of a support rim means provided with at least one opening determining the air-free suctioning-off, characterized in that the spacer means directly surrounds the inlet end of the suction funnel by a portion of the spacer means located in the upper half thereof, said portion having a larger diameter than a lower half portion, and a screen filter being arranged in the suction funnel and being force-lockingly and form-lockingly clamped in by a retaining rim clamped between the suction funnel and the portion of the spacer means surrounding said suction funnel.

2. An arrangement according to claim 1, characterized in that the support rim means is bead-like and relatively inelastic.

3. An arrangement according to claim 2, characterized in that the retaining rim is constructed flange-like.

4. An arrangement according to claim 3, characterized in that the screen filter is provided with synthetic resinous coating at the retaining rim.

5. An arrangement according to claim 4, characterized in that the inlet end of the suction funnel includes an external collar which, together with the retaining rim supportingly engages into an annular groove provided in the spacer means.

6. An arrangement according to claim 5, characterized in that a section of the spacer means connecting the upper with the lower portion thereof is inwardly curved so that in case of upward deformation of the bottom of the oil pan, said section spring-deflects into the screen filter with simultaneous abutment thereat.

7. An arrangement according to claim 1, characterized in that the screen filter is provided with synthetic resinous coating at the retaining rim.

8. An arrangement according to claim 1, characterized in that the inlet end of the suction funnel includes an external collar which, together with the retaining rim supportingly engages into an annular groove provided in the spacer means.

9. An arrangement according to claim 1, characterized in that a section of the spacer means connecting the upper with the lower portion thereof is inwardly curved so that in case of upward deformation of the bottom of the oil pan, said section spring-deflects into the screen filter with simultaneous abutment thereat.

10. An arrangement according to claim 9, characterized in that the spacer means includes substantially cylindrically shaped top and bottom portions connected with each other by way of an inwardly extending section passing over into the bottom portion by way of a curved portion.

11. An arrangement according to claim 10, characterized in that the cylindrically shaped top portion of said spacer means has an inner diameter slightly smaller than the outer diameter of the inlet end of the suction funnel, said top portion being elastically prestressed to sealingly engage over the outer diameter of the inlet end of the suction funnel.

12. An arrangement according to claim 10, characterized in that a clamping ring secures the cylindrically shaped top portion of said spacer means, which directly surrounds the inlet end of the suction funnel, to the suction funnel.

13. An arrangement according to claim 1, characterized in that the larger diameter of the portion at the upper half of the spacer means includes an inner diameter slightly smaller than the outer diameter of the inlet end of the suction funnel, said portion at the upper half being elastically prestressed to sealingly engage over the outer diameter of the inlet end of the suction funnel.

14. An arrangement according to claim 1, characterized in that a clamping ring secures the portion at the upper half of the spacer means, which directly surrounds the inlet end of the suction funnel, to the suction funnel.

* * * * *